US006064160A

United States Patent [19]

Nakamura

[11] Patent Number: 6,064,160

[45] Date of Patent: May 16, 2000

[54] LIGHT MODULATION CIRCUIT

[75] Inventor: Kyotaro Nakamura, Nara, Japan

[73] Assignee: Sharp Kabushiki Kaisha, Osaka, Japan

[21] Appl. No.: 09/053,370

[22] Filed: Apr. 1, 1998

[30] Foreign Application Priority Data

Apr. 4, 1997 [JP] Japan ..... 9-086434

[51] Int. Cl.[7] ..... G05F 1/00

[52] U.S. Cl. ..... 315/291; 315/307; 315/224; 315/282; 315/DIG. 4

[58] Field of Search ..... 315/291, 307, 315/224, 282, 254, 257, 158, DIG. 4; 345/102, 87; 349/61

[56] References Cited

U.S. PATENT DOCUMENTS

| | | | |
|---|---|---|---|
| 5,235,254 | 8/1993 | Ho | 315/219 |
| 5,272,327 | 12/1993 | Mitchell et al. | 250/205 |
| 5,844,540 | 12/1998 | Terasaki | 345/102 |

FOREIGN PATENT DOCUMENTS

| | | |
|---|---|---|
| 6-167694 | 6/1994 | Japan . |
| 6-325890 | 11/1994 | Japan . |

*Primary Examiner*—Haissa Philogene
*Attorney, Agent, or Firm*—David G. Conlin; Richard E. Gamache; Dike, Bronstein, Roberts & Cushamn, LLP

[57] ABSTRACT

A light modulation circuit is provided which includes: a cold cathode tube; an inverter for turning the cold cathode tube on and off; and an adjustor for adjusting a current flowed through the cold cathode tube.

3 Claims, 7 Drawing Sheets

LIGHT MODULATION CIRCUIT

BACKGROUND OF THE INVENTION

1. Field of the Invention

The present invention relates to a light modulation circuit for driving backlight of a liquid crystal display device.

2. Description of the Related Art

Generally, a cold cathode tube such as a fluorescent lamp is used as backlight of a liquid crystal display device. The backlight of the liquid crystal display device often needs to be modulated in view of battery life where the liquid crystal display device is incorporated in a small-sized portable apparatus, or in view of display enhancement where the display is used outdoor, indoor and in various other situations. A pulse width modulation (hereinafter, simply referred to as "PWM") technique is one of the known techniques for modulating the backlight. According to the PWM technique, a light source is periodically turned on and off while a ratio of ON and OFF periods of the light source is changed.

FIG. 7 is a circuit diagram showing a light modulation circuit disclosed in Japanese Laid-Open Publication No. 6-325890. Referring to FIG. 7, the light modulation circuit includes a light modulator 30, an oscillator 31, a transformer 13, a fluorescent lamp 14, a transistor Q3 and the like.

FIG. 8 is a waveform diagram showing waveforms of signals of the light modulation circuit shown in FIG. 7.

Referring to FIG. 8, when a mode of a signal S1 transits from a light non-modulation mode to a light modulation mode, the oscillator 31 generates a signal S2 which alternately repeats a high level and a low level. When the signal S2 is at the low level, the transistor Q3 is electrically connected, whereby the light modulation circuit shown in FIG. 7 generates signals S3 and S4.

SUMMARY OF THE INVENTION

In one aspect of the present invention, a light modulation circuit is provided which includes: a cold cathode tube; an inverter for turning the cold cathode tube on and off; and an adjustor for adjusting a current flowed through the cold cathode tube.

According to one embodiment of the present invention, a light modulation circuit further includes a transformer having a primary coil and a secondary coil. The primary coil of the transformer is electrically connected to the inverter, and the secondary coil of the transformer is electrically connected to the adjustor.

According to another embodiment of the present invention, a light modulation circuit which is mounted in a portable information apparatus, further includes a controller which prevents the inverter from generating a signal for driving the cold cathode tube in order to give the portable information apparatus an opportunity to transmit a signal, and which controls the adjustor to increase an amount of current flowed through the cold cathode tube in order to compensate deterioration of a light modulation level caused by preventing the inverter from generating a signal for driving the cold cathode tube.

According to still another embodiment of the present invention, the adjustor includes a plurality of capacitors.

Thus, the invention described herein makes possible the advantage of providing a light modulation circuit in which freedom for changing a light modulation level of a cold cathode tube can be increased.

This and other advantages of the present invention will become apparent to those skilled in the art upon reading and understanding the following detailed description with reference to the accompanying figures.

DESCRIPTION OF THE PREFERRED EMBODIMENTS

Figure 1:
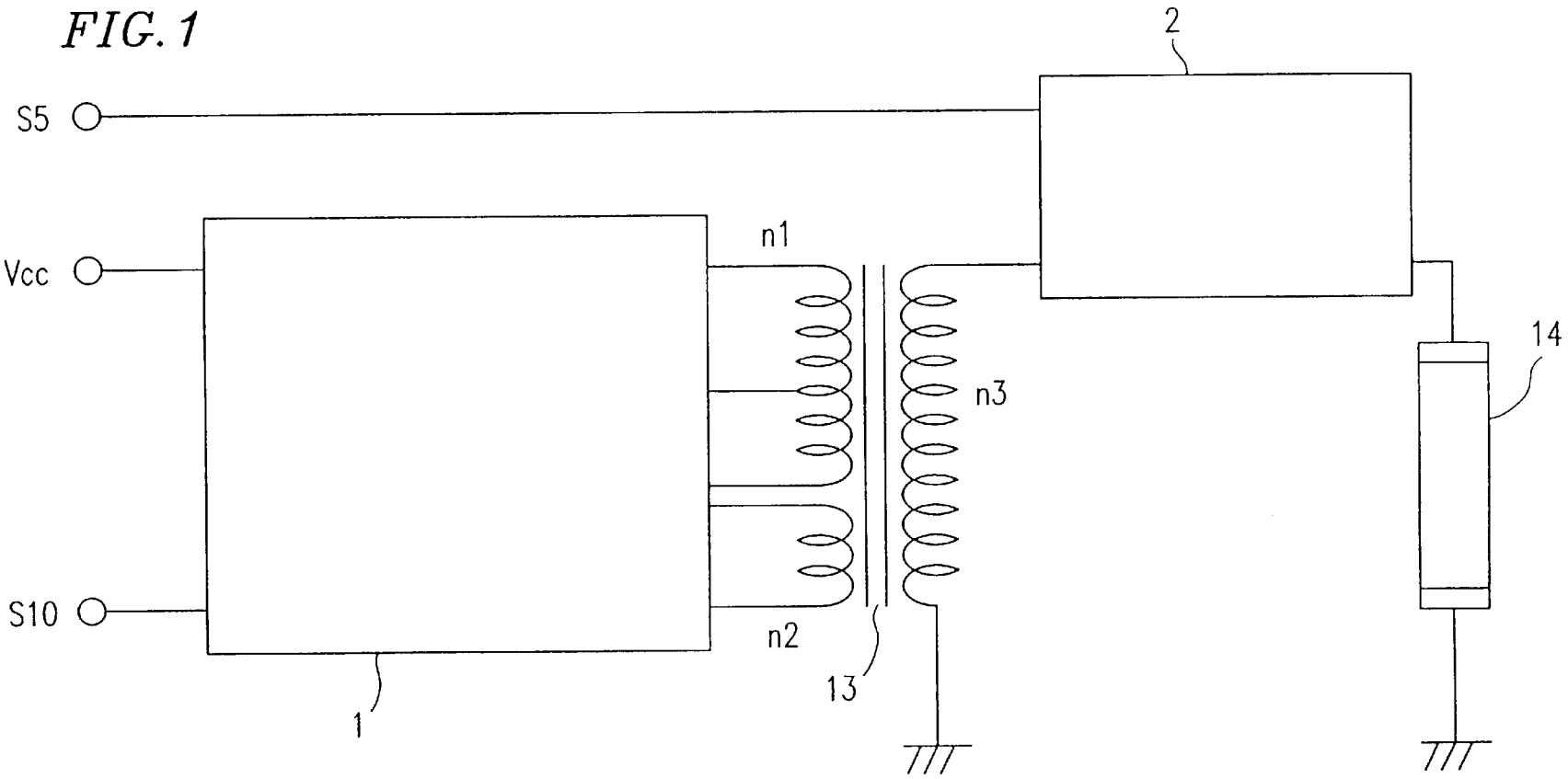
FIG. 1 is a schematic circuit diagram showing an exemplary structure of a light modulation circuit according to the present invention.

Hereinafter, the present invention will be described by way of illustrative examples with reference to the accompanying drawings. Like reference numerals designate like components.

FIG. 1 is a schematic circuit diagram showing an exemplary structure of a light modulation circuit according to the present invention. The light modulation circuit includes an inverter 1, an adjustor 2, a transformer 13 and a cold cathode tube 14 such as a fluorescent lamp.

The inverter 1 receives a signal S10 from outside and performs waveform shaping on a voltage Vcc applied to the inverter 1 based on the signal S10. The voltage subjected to the waveform shaping is applied to a primary coil n1 of the transformer 13. A voltage induced upon a secondary coil n3 is applied to the adjustor 2. The adjustor 2 receives an external light modulation control signal S5 as well and changes an impedance of a closed circuit including the secondary coil n3 of the transformer 13, the adjustor 2 and the cold cathode tube 14, based on the light modulation control signal S5. By changing the impedance of the closed circuit (e.g., an impedance of the adjustor 2), a current flowed through the cold cathode tube 14 is adjusted.

EXAMPLE 1

Figure 2:
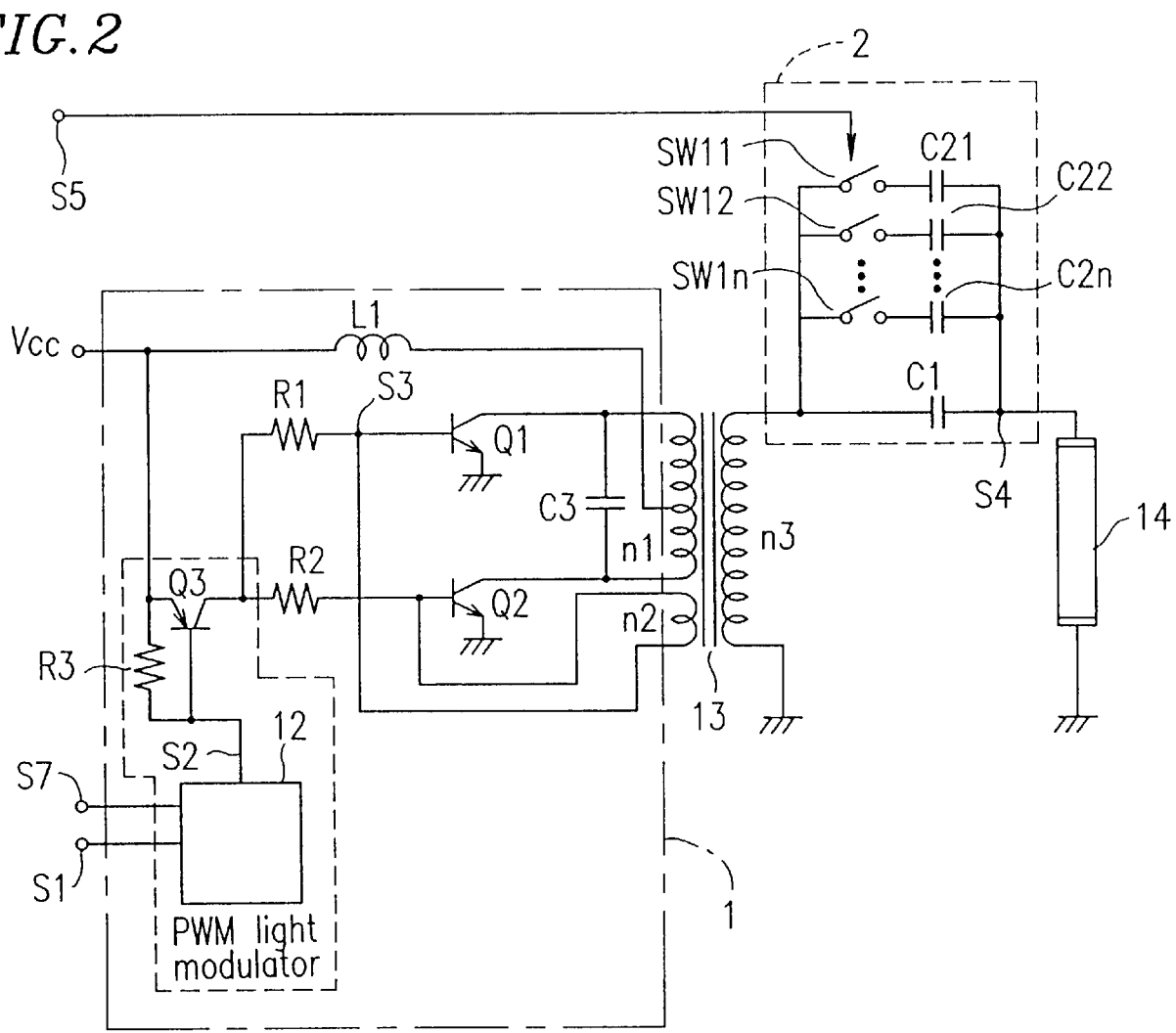
FIG. 2 is a schematic circuit diagram showing an exemplary structure of the light modulation circuit according to a first example of the present invention.

Hereinafter, a light modulation circuit according to a first example of the present invention will be described with reference to FIG. 2. FIG. 2 is a schematic circuit diagram showing an exemplary structure of the light modulation circuit according to the first example of the present invention.

Referring to FIG. 2, the light modulation circuit includes an invertor 1, an adjustor 2, a transformer 13 and a cold cathode tube 14.

The inverter 1 includes transistors Q1 to Q3, resistors R1 to R3, a capacitor C3, a coil L1 and an oscillator 12.

Figure 3:
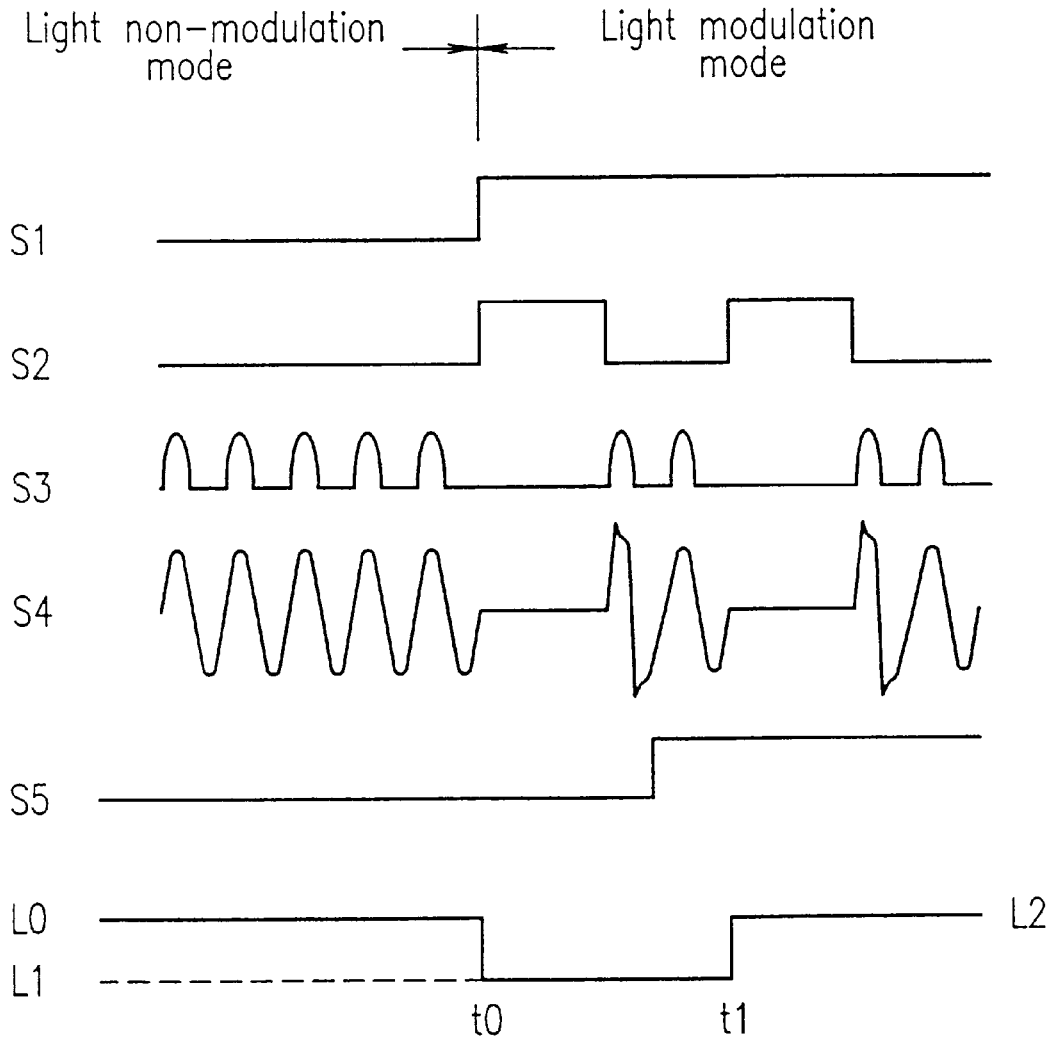
FIG. 3 is a waveform diagram showing examples of waveforms of signals of the light modulation circuit according to the first example of the present invention shown in FIG. 2.

The oscillator 12 receives a mode signal S1 and a duty factor signal S7 as a mode signal S10 shown in FIG. 1. The oscillator 12 generates an output signal S2 based on the mode signal S1 and the duty factor signal S7. The mode signal S1 indicates either a light modulation mode or a light non-modulation mode. FIG. 3 is a waveform diagram showing examples of waveforms of signals of the light modulation circuit shown in FIG. 2, including the mode signal S1 and the output signal S2. Details of the duty factor signal S7 will be described later.

Returning to FIG. 2, the adjustor 2 includes switches SW11 to SW1n and capacitors C21 to C2n. The adjustor 2 controls open and close states of each of the switches SW11 to SW1n based on the light modulation control signal S5.

Hereinafter, an operation of the light modulation circuit according to the first example of the present invention shown in FIG. 2 will be described.

A voltage Vcc is applied to a midpoint of a primary coil n1 of the transformer 13 via the coil L1. Upon receiving a mode signal S1 indicating a light non-modulation mode, for example, a low level signal, the oscillator 12 generates a low level signal, whereby the transistor Q3 is electrically connected.

When the mode signal S1 indicates a light non-modulation mode, a voltage signal S3 having a frequency which is substantially determined by the primary coil n1 of the transformer 13 and the capacitor C3 is applied to bases of the transistors Q1 and Q2 via a feedback coil n2 of the transformer 13. A voltage induced upon the secondary coil n3 of the transformer 13 is applied to the cold cathode tube 14 connected via the adjustor 2. The light modulation level of the cold cathode tube 14 before time t0 is at level L0 (FIG. 3).

At time t0, the oscillator 12 receives a mode signal S1 indicating a light modulation mode which is, for example, a high level signal. Upon receiving the mode signal S1 indicating the light modulation mode, the oscillator 12 outputs an output signal S2 which periodically alters its level. For example, the output signal S2 alternates between the high level and the low level. A ratio of the high level and low level is determined by the duty factor signal S7.

While the output signal S2 is at a high level, the transistor Q3 is electrically disconnected. While the transistor Q3 is electrically disconnected, the transistors Q1 and Q2 are also electrically disconnected since a base current is not provided to the bases thereof. Accordingly, a voltage is not induced upon the secondary coil n3 of the transformer 13, and thus, the cold cathode tube 14 is not turned on.

While the output signal S2 is at a low level, the cold cathode tube 14 is turned on, as previously described for the light non-modulation mode.

Light emitting luminance of the cold cathode tube 14 where the output signal S2 changes between the high level and the low level (the mode signal S1 is low level), is lower than light emitting luminance of the cold cathode tube 14 where the output signal S2 is at the low level (the mode signal S1 is high level). A light modulation level during a period of time t0 to time t1 is at level L1 (FIG. 3).

The longer the period the output signal S2 is at a high level, the lower the light emitting luminance of the cold cathode tube 14 becomes. On the other hand, the shorter the period of the output signal S2 being at a high level, the higher the light emitting luminance of the cold cathode tube 14 becomes. By changing the duty factor signal S7, the light modulation level of the cold cathode tube 14 can be about 5 to 95% of the light modulation level in a light non-modulation mode. Furthermore, when the light modulation circuit receives a light modulation control signal S5 by which the switches SW11 to SW1n are switched on, the largest amount of current is flowed through the cold cathode tube 14. The switches SW11 to SW1n are switched on at time t1, then the light modulation level is at level L2. The magnitudes of the light modulation levels L0 and L2 depend on a duty factor of an output signal and a capacitance of the adjustor 2. The magnitudes of the light modulation levels L0 and L2 may be equal.

EXAMPLE 2

Figure 4:
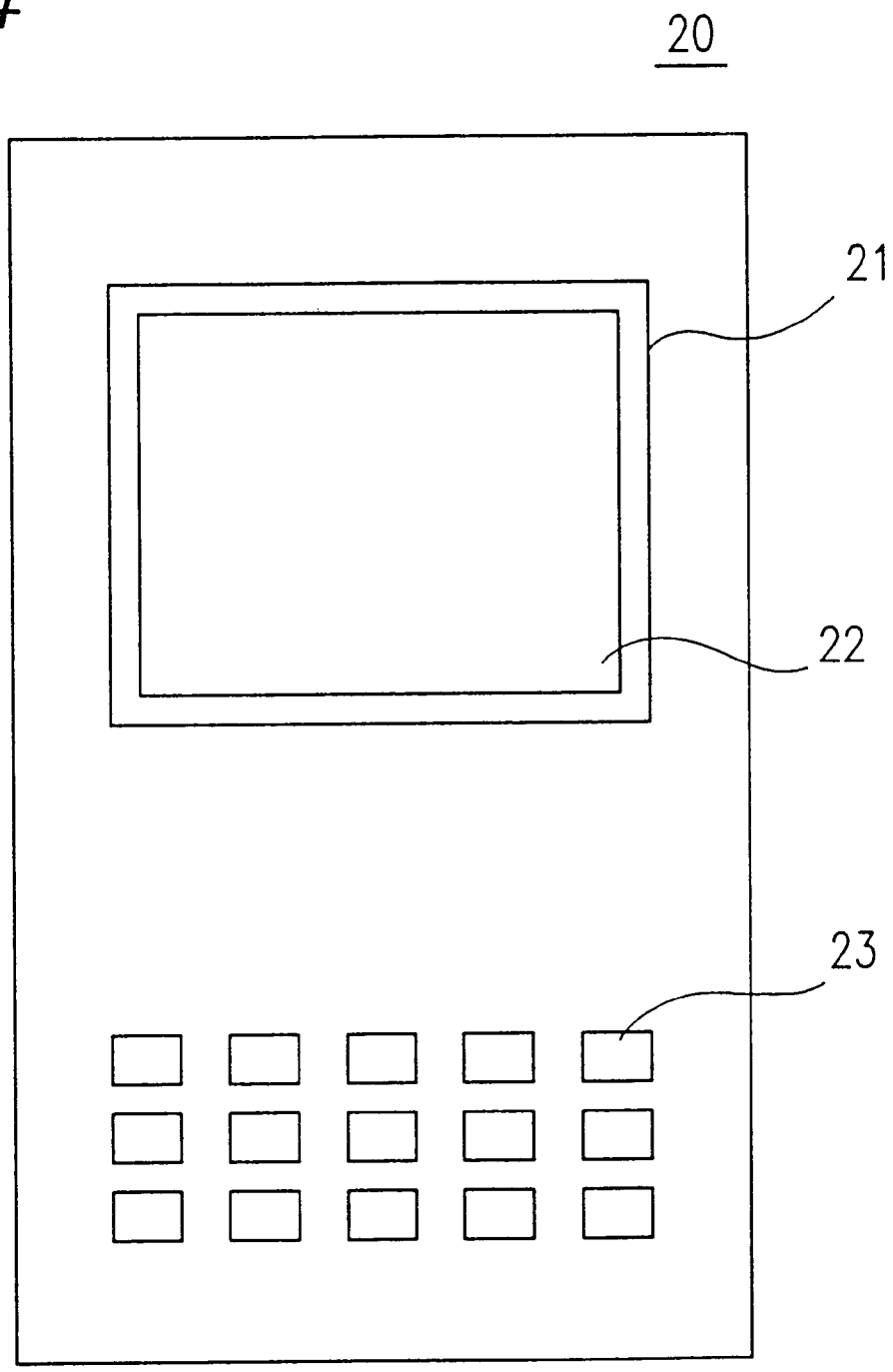
FIG. 4 is a schematic diagram showing an example of a portable information apparatus in which the light modulation circuit according to a second example of the present invention is mounted.

Hereinafter, a light modulation circuit according to a second example of the present invention will be described. FIG. 4 is a schematic diagram showing an example of a portable information apparatus 20 in which the light modulation circuit according to the second example of the present invention is mounted.

Referring to FIG. 4, the portable information apparatus 20 includes input device(s) such as a touch panel 22 provided on a liquid crystal display panel 21 and/or keys 23. The touch panel 22 may be a tablet. The tablet includes two transparent conductive films which are arranged in a facing manner with a space therebetween. When an element such as a pen touches the transparent conductive film, the upper and the lower transparent conductive films make contact with each other, whereby a resistance value between the transparent conductive films is determined so as to detect a position where the pen touched the transparent conductive film.

When the light modulation circuit performs light modulation, undesirable radiation noise may be generated at a cold cathode tube and/or an invertor. In this case, the input device(s) is affected by the undesirable radiation noise where the input device(s) may not be able to input correct data to the portable information apparatus 20.

Since the cold cathode tube (not shown) is provided beneath the liquid crystal display panel 21, the touch panel 22 is more likely to be affected by the undesirable radiation noise. For this reason, the touch panel 22 detects the touched position while the cold cathode tube is not provided with a signal (a pulse) for driving the cold cathode tube.

For example, in a light non-modulation mode, the signal for driving the cold cathode tube is continuously provided, and therefore, the touched position of the touch panel 22 cannot be detected. In the light modulation mode, the portable information apparatus 20 is able to detect the touched position of the touch panel 22 but the light modulation level of the cold cathode tube is deteriorated. It is desirable to maintain the light modulation level even in the light non-modulation mode.

Hereinafter, an exemplary structure of the light modulation circuit according to the second example will be described.

Figure 5:
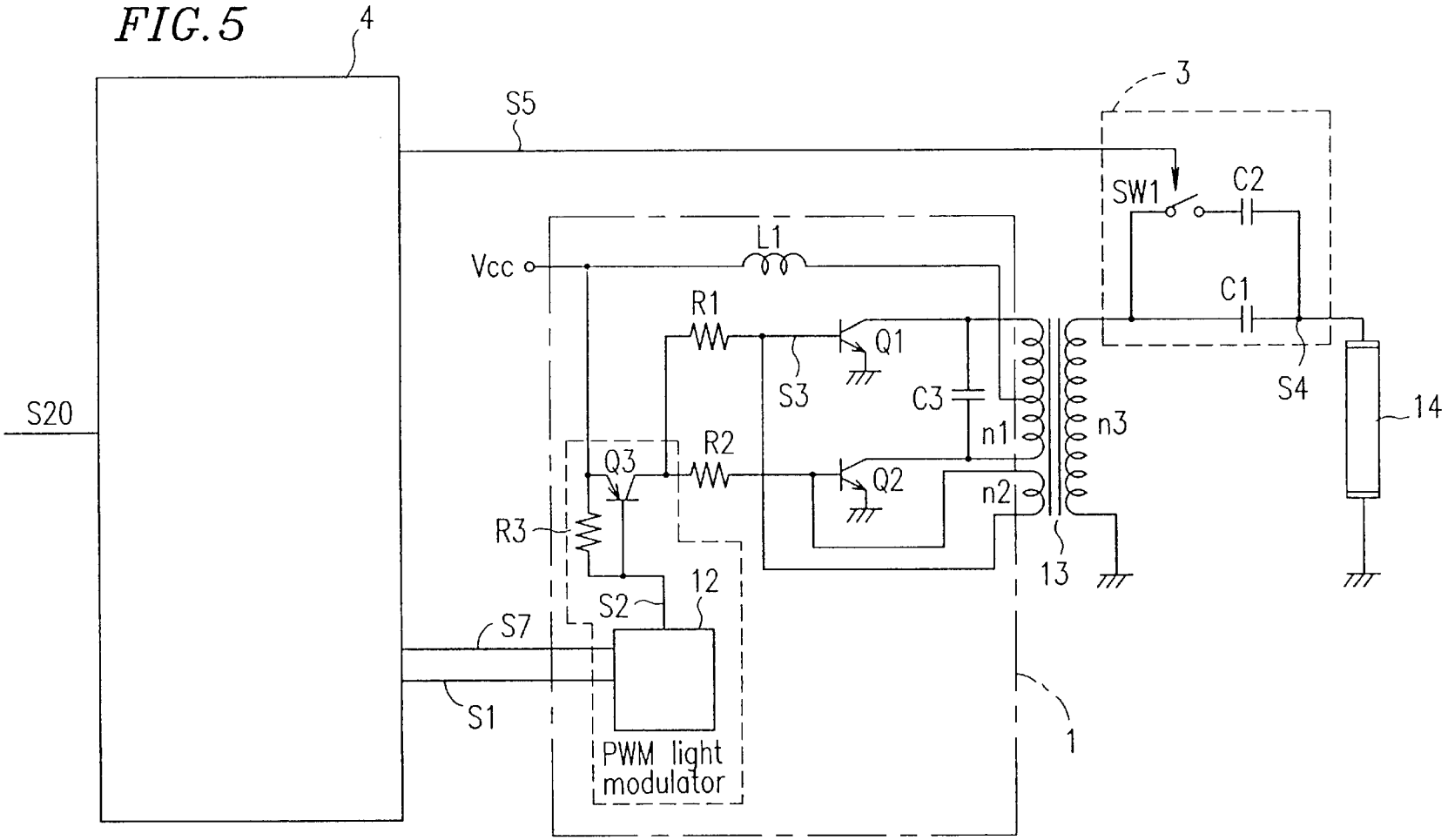
FIG. 5 is a circuit diagram showing the exemplary structure of the light modulation circuit according to the second example of the present invention.

FIG. 5 is a circuit diagram showing the exemplary structure of the light modulation circuit according to the second example of the present invention. Referring to FIG. 5, the light modulation circuit includes an invertor 1, an adjustor 3, a transformer 13, a cold cathode tube 14 and a controller 4. The structure of the light modulation circuit according to the second example of the present invention shown in FIG. 5 is substantially the same as that of the light modulation circuit according to the first example of the present invention shown in FIG. 2, except for the adjustor 3 and the controller 4. The same reference numerals used in FIGS. 2 and 5 designate like components, and thus the descriptions thereof are omitted.

The adjustor 3 includes a switch SW1 and capacitors C1 and C2.

In order to increase the capacitance of the adjustor 3, the switch SW1 is closed. When the capacitance of the adjustor 3 increases, a large amount of current flows through the cold cathode tube 14, whereby the light intensity of the cold cathode tube 14 intensifies.

The controller 4 prevents the inverter 1 from generating a signal for driving the cold cathode tube 14 in order to give the portable information apparatus 20 an opportunity to transmit a signal. Furthermore, the controller 4 controls the adjustor 3 to increase the amount of current flowed through the cold cathode tube 14 in order to compensate the deterioration of the light modulation level caused by preventing the inverter 1 from generating a signal for driving the cold cathode tube 14. For example, in order to give the portable information apparatus 20 an opportunity to detect a touched position of the touch panel 22, the controller 4 generates a mode signal S1 indicating a light modulation mode and further generates a light modulation control signal S5 for compensating the deterioration of the light modulation level. Specifically, upon receiving an external signal S20, the controller 4 sets the mode signal S1 and the light modulation control signal S5 to high levels. By doing so, the portable information apparatus 20 is given an opportunity to detect the touched position of the touch panel 22, and also the light modulation level of the cold cathode tube 14 is compensated.

The signal, which is given the opportunity for transmitting in the portable information apparatus 20, is easily affected by the undesirable radiation noise.

Figure 6:
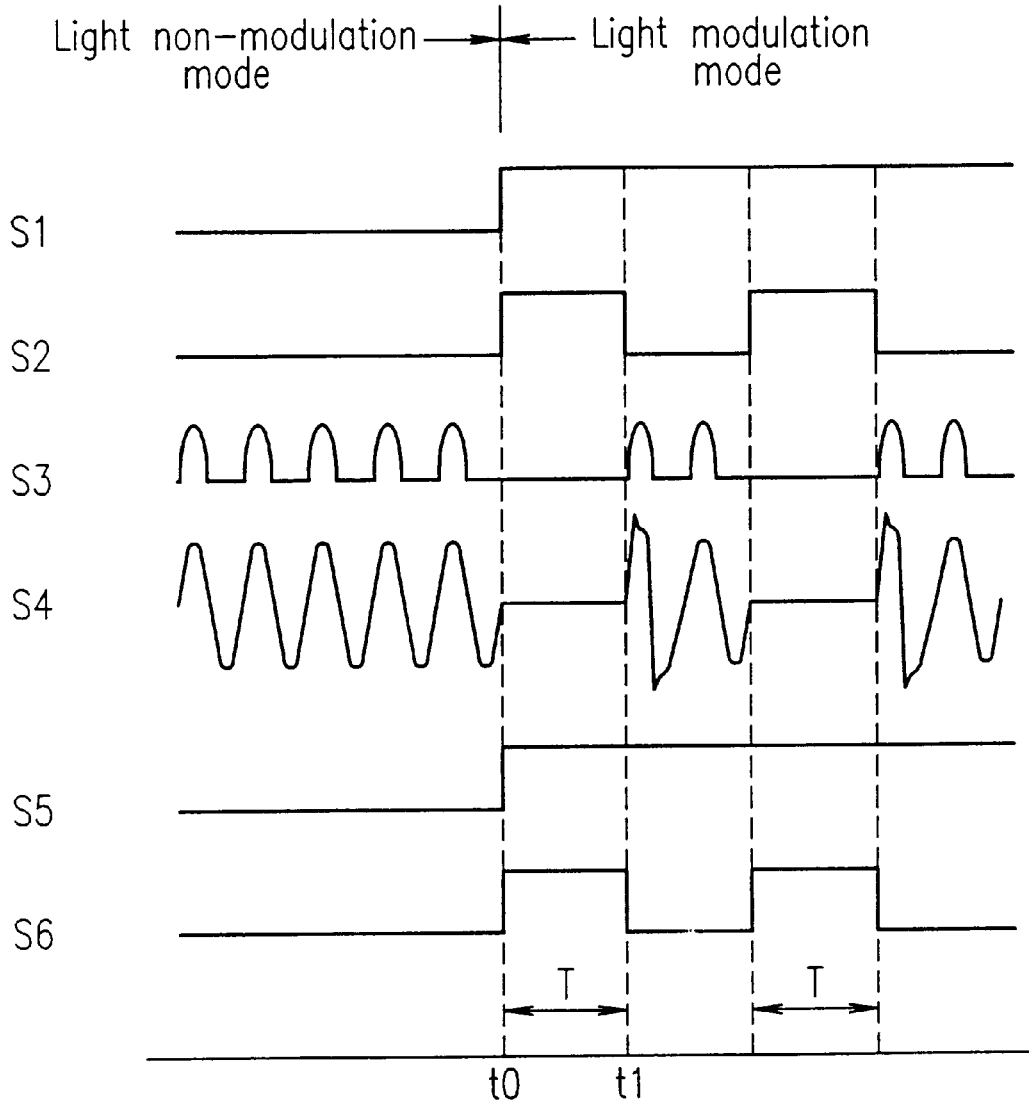
FIG. 6 is a waveform diagram showing waveforms of signals of the light modulation circuit according to the second example of the present invention shown in FIG. 5.
Figure 7:
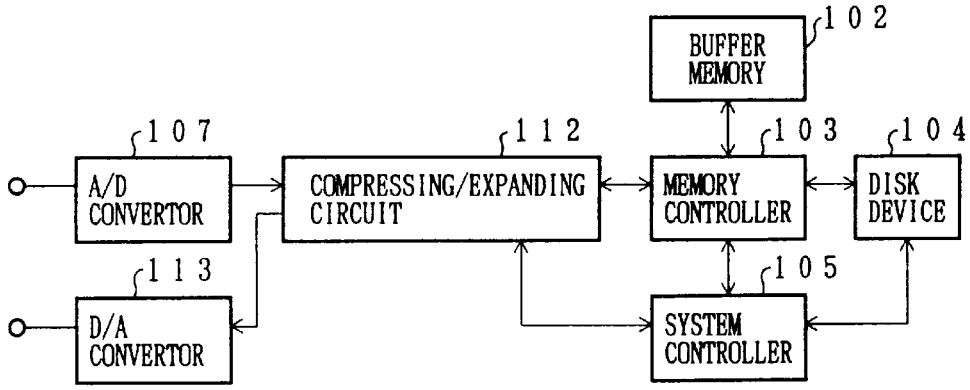
FIG. 7 PRIOR ART
FIG. 7 is a circuit diagram showing an exemplary structure of a conventional light modulation circuit.
Figure 8:
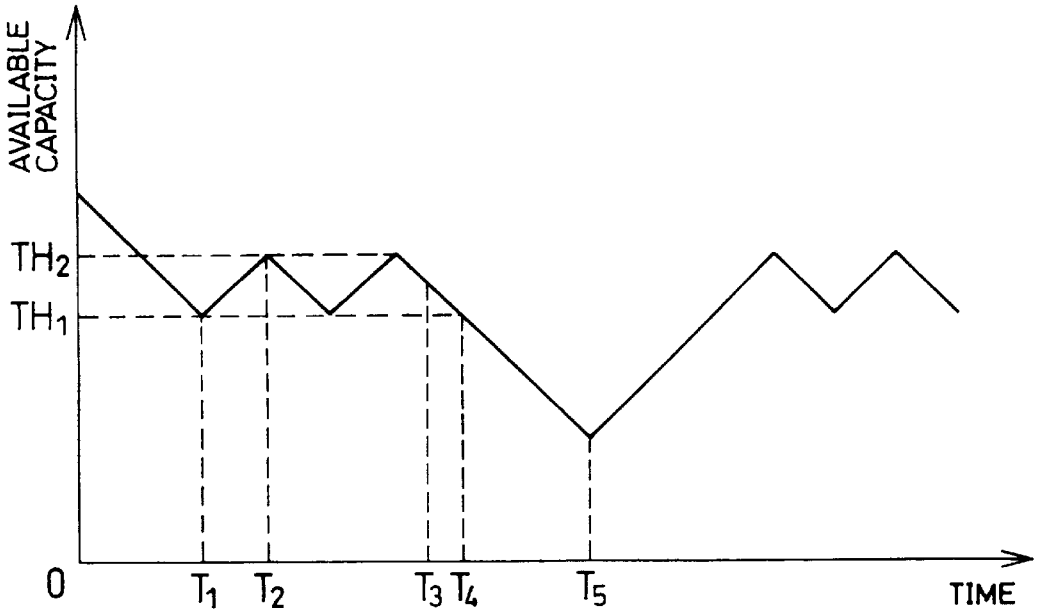
FIG. 8 PRIOR ART
FIG. 8 is a waveform diagram showing waveforms of signals of the conventional light modulation circuit shown in FIG. 7.

Hereinafter, an operation of the light modulation circuit according to the second example of the present invention shown in FIG. 5 will be described with reference to FIG. 6. FIG. 6 is a waveform diagram showing waveforms of signals of the light modulation circuit shown in FIG. 5.

At time t0, the controller 4 receives a signal S20 for giving the portable information apparatus 20 an opportunity to detect the touched position of the touch panel 22. Upon receiving the signal S20, the controller 4 sets the mode signal S1 and the light modulation signal S5 to high levels. Herein, the duty factor signal is predetermined.

Since the light modulation signal S5 is at a high level, the switch SW1 is closed. The capacitance of the adjustor 3 increases, and a large amount of current is flowed through the cold cathode tube 14, whereby the light intensity of the cold cathode tube 14 intensifies.

The oscillator 12 generates an output signal S2. While the output signal S2 is at a high level, the transistor Q3 is electrically disconnected. While the transistor Q3 is electrically disconnected, the transistors Q1 and Q2 are also electrically disconnected since a base current is not provided to the bases thereof. Accordingly, a voltage is not induced upon the secondary coil n3 of the transformer 13, and thus, the cold cathode tube 14 is turned off.

While the output signal S2 is at a high level, the touch panel 22 outputs a signal S6 indicating a detected position. An operation of the light modulation circuit according to the second example of the present invention during the period where the output signal S2 is at a low level is the same as that described in the first example, and thus the description thereof is omitted.

According to the second example of the present invention, while the portable information apparatus 20 is given an opportunity to detect the touched position of the touch panel 22, the apparent luminance is maintained unvaried. According to the second example of the present invention, when necessary, the adjustor 3 may control the apparent luminance.

According to the second example of the present invention, the adjustor 2 used in the first example of the present invention may be used instead of the adjustor 3. Similarly, the adjustor 3 may be used in the light modulation circuit according to the first example of the present invention.

The present invention is not only applicable for detecting the touched position of the touch panel. For example, the present invention can be implemented in a portable information apparatus in order to correctly process signals which are sensitive to undesirable radiation noise without changing the apparent luminance.

A light modulation circuit according to the present invention includes an inverter for turning on and off a cold cathode tube, and an adjustor for adjusting a current flowed through the cold cathode tube. Therefore, freedom for changing light modulation level of the cold cathode tube increases.

The light modulation circuit according to the present invention may be mounted on a portable information apparatus. A controller prevents the inverter from generating a signal for driving the cold cathode tube in order to give the portable information apparatus an opportunity to transmit a signal. Furthermore, the controller controls the adjustor to increase the amount of current flowed through the cold cathode tube in order to compensate the deterioration of the light modulation level caused by preventing the inverter from generating a signal for driving the cold cathode tube.

Accordingly, a noise generated at the cold cathode tube is not superimposed on a signal transmitted through the portable information apparatus. Moreover, since the light modulation levels of the cold cathode tube are the same before and after the portable information apparatus is given an opportunity to transmit a signal, a user manipulating the portable information apparatus does not feel uncomfortable and thus convenient manipulation is provided to the user.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A light modulation circuit, comprising:

a cold cathode tube;

an inverter for turning the cold cathode tube on and off;

an adjustor for adjusting a current flowed through the cold cathode tube; an a transformer having a primary coil and a secondary coil, wherein the primary coil of the transformer is electrically connected to the inverter, and the secondary coil of the transformer is electrically connected to the adjustor, wherein the adjustor adjusts current flowed through the cold cathode tube based on a light modulation control signal in accordance with a light modulation mode or a light non-modulation mode.

2. A light modulation circuit according to claim 1, wherein the adjustor includes a plurality of capacitors.

3. A light modulation circuit, comprising:

a cold cathode tube;

an inverter for turning the cold cathode tube on and off; and an adjustor for adjusting a current flowed through the cold cathode tube, which is mounted in a portable information apparatus, further comprising a controller which prevents the inverter from generating a signal for driving the cold cathode tube in order to give the portable information apparatus an opportunity to transmit a signal, and which controls the adjustor to increase an amount of current flowed through the cold cathode tube in order to compensate deterioration of a light modulation level caused by preventing the inverter from generating a signal for driving the cold cathode tube.

* * * * *